US008393941B2

(12) United States Patent
Ghinelli

(10) Patent No.: US 8,393,941 B2
(45) Date of Patent: Mar. 12, 2013

(54) ABRASIVE TOOL

(75) Inventor: Serafino Ghinelli, Rimini (IT)

(73) Assignee: Serafino Ghonelli, Rimini (IT)

( * ) Notice: Subject to any disclaimer, the term of this patent is extended or adjusted under 35 U.S.C. 154(b) by 477 days.

(21) Appl. No.: 12/735,054

(22) PCT Filed: Jan. 28, 2008

(86) PCT No.: PCT/IT2008/000043

§ 371 (c)(1),
(2), (4) Date: Jun. 11, 2010

(87) PCT Pub. No.: WO2009/075004

PCT Pub. Date: Jun. 18, 2009

(65) Prior Publication Data

US 2010/0255765 A1 Oct. 7, 2010

(30) Foreign Application Priority Data

Dec. 12, 2007 (IT) ..... MC2007A0237

(51) Int. Cl.
*B23F 21/03* (2006.01)

(52) U.S. Cl. ..... 451/540; 451/548; 451/550; 451/526; 451/527

(58) Field of Classification Search ..... 451/526, 451/527, 529, 530, 539, 541, 548, 550; 51/298
See application file for complete search history.

(56) References Cited

U.S. PATENT DOCUMENTS

| | | | | | |
|---|---|---|---|---|---|
| 794,495 | A * | 7/1905 | Gorton | 451/529 |
| 794,496 | A * | 7/1905 | Gorton | 451/529 |
| 970,618 | A * | 9/1910 | Gardner | 451/548 |
| 1,635,350 | A * | 7/1927 | Simons | 451/527 |
| 1,657,784 | A * | 1/1928 | Bergstrom | 51/295 |
| 2,292,261 | A * | 8/1942 | Albertson | 451/527 |
| 2,334,642 | A * | 11/1943 | Moore | 451/488 |
| 2,826,015 | A * | 3/1958 | Osenberg | 451/527 |
| 3,745,719 | A * | 7/1973 | Oswald | 451/548 |
| 3,774,355 | A * | 11/1973 | Dawson et al. | 451/527 |
| 3,874,126 | A * | 4/1975 | Catlin et al. | 451/525 |
| 3,885,358 | A * | 5/1975 | Enzian | 451/526 |
| 3,991,527 | A * | 11/1976 | Maran | 451/529 |
| 4,142,334 | A * | 3/1979 | Kirsch et al. | 451/539 |
| 5,174,795 | A * | 12/1992 | Wiand | 51/295 |
| 5,177,908 | A * | 1/1993 | Tuttle | 451/41 |
| 5,197,249 | A * | 3/1993 | Wiand | 451/529 |
| 5,247,765 | A * | 9/1993 | Quintana | 451/548 |
| 6,234,886 | B1 * | 5/2001 | Rivard et al. | 451/353 |
| 6,354,929 | B1 * | 3/2002 | Adefris et al. | 451/527 |
| 6,371,842 | B1 * | 4/2002 | Romero | 451/540 |
| 6,811,579 | B1 * | 11/2004 | von Dungen et al. | 51/293 |
| 6,837,780 | B1 * | 1/2005 | Broido | 451/527 |
| 6,893,325 | B2 * | 5/2005 | Robinson | 451/28 |
| 7,004,823 | B2 * | 2/2006 | Kisboll et al. | 451/57 |
| 7,066,795 | B2 * | 6/2006 | Balagani et al. | 451/285 |
| 2007/0254568 | A1 * | 11/2007 | Park | 451/548 |
| 2009/0053982 | A1 * | 2/2009 | Popov | 451/527 |

* cited by examiner

*Primary Examiner* — George Nguyen

(74) *Attorney, Agent, or Firm* — Lowe, Hauptman, Ham & Berner, LLP

(57) ABSTRACT

The present invention relates to an abrasive tool, of the type suitable to be mounted on a machine tool, comprising at least a bearing structure with abrasive material, the said bearing structure being provided with at least a grid (6) with abrasive material, the grid (6) partially protruding or emerging from a body (7) without abrasive material.

14 Claims, 2 Drawing Sheets

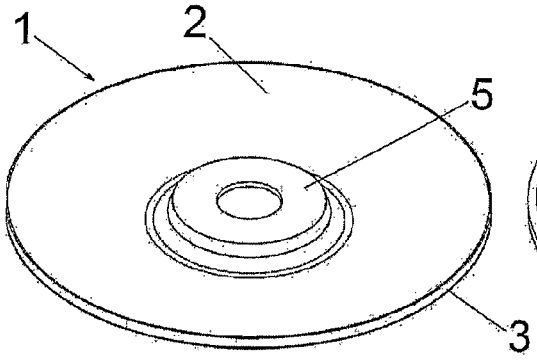
FIG. 1
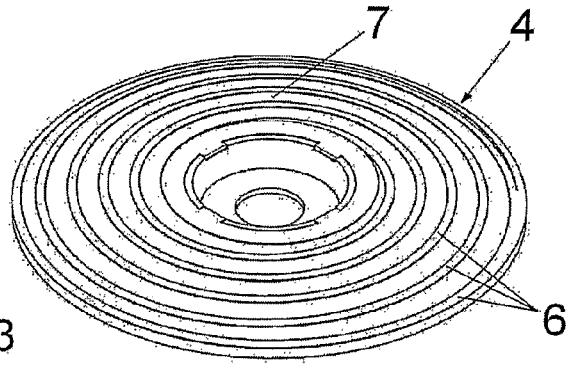
FIG. 2
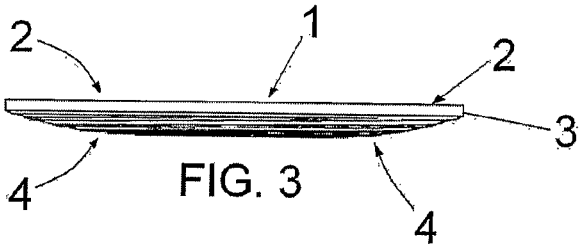
FIG. 3
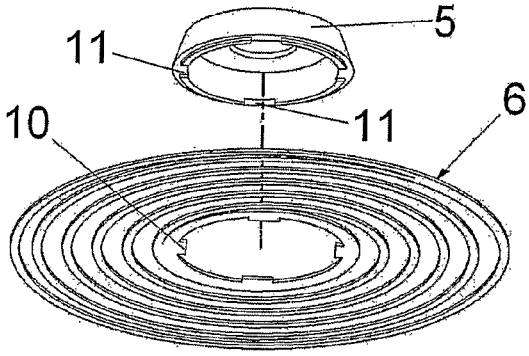
FIG. 4
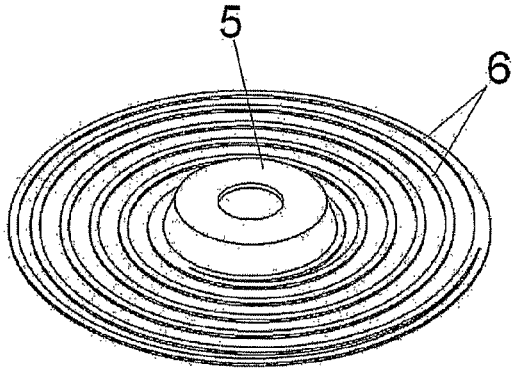
FIG. 5
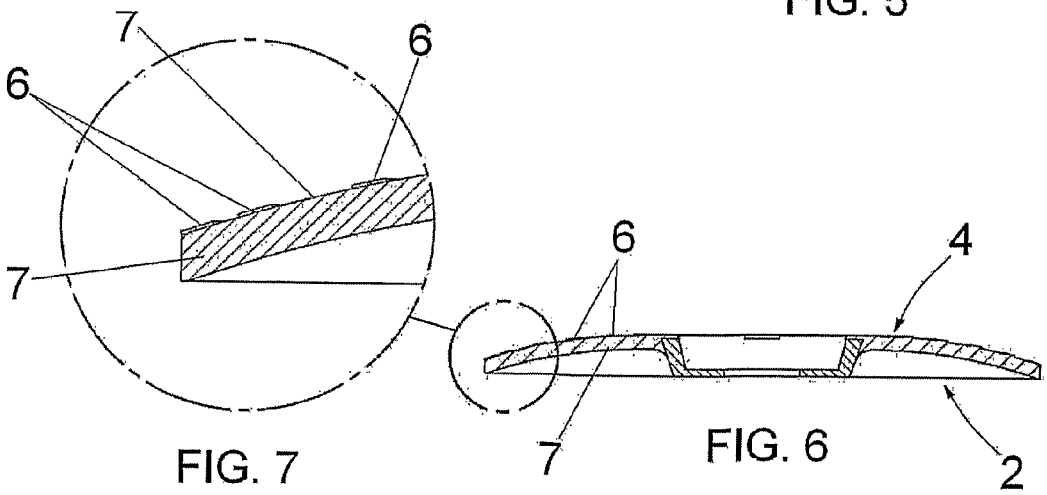
FIG. 7
FIG. 6

ABRASIVE TOOL

The present invention relates to an improved abrasive tool.

The abrasive tool is a part, having any shape, provided with abrasive and mounted on grinding machines that transmit a cyclic, linear, oscillatory, rotary motion to the tool, or, more in general, a mix of these motions; the abrasive-holding tool comes in contact with the machined piece to grind it.

A special type of abrasive tool is the so-called pad: it is a disk-shaped abrasive tool that is specially suitable to be driven in rotary motion.

The abrasive tools, and especially the pads of the known art are composed of a rigid bearing body, whose surface is coated with a layer of abrasive powders of solid or synthetic diamonds mixed with a binder, such as adhesive or similar substances.

A first inconvenience of the abrasive tools of the known art consists in the fact that, during the machining process, the abrasive tool vibrates with respect to the grinding machine with vibrations induced by the machining operation and proportional to the irregularities of the machined part: the more the irregularities, the higher the vibrations will be.

This problem is more serious in case of grinding machines that are manually supported by the operator, who gets very tired because of the vibrations; moreover, the quality and accuracy of the grinding process are likely to get worse.

Another inconvenience of the vibrations transmitted by the tool to the grinding machine is related to the life of the tool and/or grinding machine: the vibrations create high-frequency cyclic mechanical stress that results in the creation and propagation of cracks both in the material of the abrasive tool and in the parts of the grinding machine that are subjected to the vibrations, typically the drive shaft that transmits motion to the abrasive tool. The creation and propagation of the cracks causes the failure of the abrasive tool or grinding machine, thus requiring either to change the tool or repair the machine.

The purpose of the present invention is to overcome these and other inconveniences of the abrasive tools of the known art by means of an abrasive tool as claimed in claim 1.

The abrasive tool of the present invention is composed of an elastically flexible bearing structure, on which the abrasive material or element is applied, which advantageously absorbs part of the vibrations generated during the grinding process of the machined part, in particular the high-frequency vibrations that cause the aforementioned cracks and tire the operator who supports the grinding machine with his hand during the machining operation.

Another purpose of the present invention is the manufacturing process of a pad according to the present invention.

Further advantageous characteristics are the subject of the enclosed dependant claims.

These and other advantages will become evident after the description of the enclosed figures, whereby:

FIG. 1 is a perspective view of the non-abrasive side of an abrasive tool according to the present invention;

FIG. 2 is a perspective view of the abrasive side of the tool of 1;

FIG. 3 is a side view of the tool of FIG. 1;

FIG. 4 is an exploded view of the bearing structure of FIG. 1;

FIG. 5 is a view of the bearing structure of the tool of FIG. 4 in assembled condition;

FIG. 6 is a cross-sectional view of the tool of FIG. 1;

FIG. 7 is an enlarged view of the tool of FIG. 6;

Figure 8:
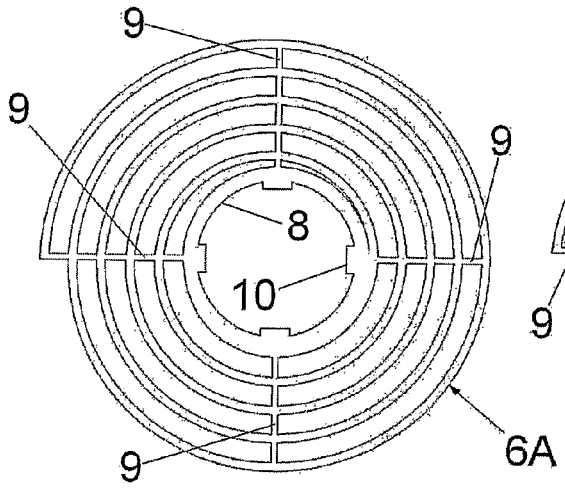
FIG. 8 illustrates an advantageous executive embodiment of a grid of the bearing structure for an abrasive tool, in particular a pad, according to the present invention.

The enclosed figure illustrate a circular abrasive tool normally defined as pad, for illustrative purposes.

The present invention also relates to a different shape of the abrasive tool, either with axial symmetry around the rotation axis of the tool or without axial symmetry, such as in the case of rectangular, square or similar tools, since experts of the art will be able to obtain such an abrasive tool according to the precepts contained herein without any inventive effort.

FIGS. 1, 2 and 3 illustrate the advantageous case of an abrasive tool (1) shaped as a pad comprising a rear side (2) designed to be mounted facing the grinding machine (not shown) without abrasive and coupled with a lateral shell (3) that identifies the thickness of the pad, and a machining side (4) designed to be mounted facing the piece to be machined (not shown) with abrasive. The pad is coupled with the machine tool by means of a flange (5) designed to transmit motion to the pad that rotates around its axis.

As shown in FIGS. 1, 2 and 3, the pad, or more in general the abrasive tool of the present invention comprises a bearing structure composed of: an elastic grid (6) on which the abrasive material is fixed, the said elastic grid (6) being associated with an elastic body (7) and coupled with the flange (5).

The bearing structure gives elasticity or elastic flexibility to the abrasive tool (1), which is advantageously able to absorb the vibrations, especially high-frequency vibrations, that are generated during the machining process.

According to a specially advantageous feature, the elastic grid (6) is made of metal material, while the body (7) is made of plastic, especially polymeric or silicone material.

The elasticity of the metal grid (6) is guaranteed by the reduced thickness and shape, as illustrated hereinafter, while the elasticity of the body (7) is intrinsic to the plastic material; the flange (5) is rigid, being designed to transmit the tool (1) the torque generated by the machine on which the tool is fixed by means of the flange (5).

Moreover, because of the presence of the metal grid (6) and the plastic body (7), the abrasive material is fixed to the grid (6) by means of an inexpensive process without using any adhesive, that is to say by means of a galvanic bath, as illustrated hereinafter.

The grid (6) is coupled with the body (7) by partially drowning the grid (6) in the material of the body (7), for instance by means of co-moulding, in such a way at least one side of the grid (6) protrudes or emerges from the body (7) on the side facing the machining side (4).

As shown in FIG. 2, and also with reference to FIGS. 6 and 7, part of the grid (6) protrudes from the machining side (4) in alternation with parts of the body (7), in such a way that the machining side (4) has alternate bands of abrasive material, i.e. the grid (6), and bands without abrasive material, i.e. the body (7).

Advantageously, as shown in FIGS. 1 and 6, the machining side of the body (7) is convex, with concavity on the rear side (2) in order to exploit the elasticity of the bearing structure and simplify the operator's work: theoretically, in case of a rigid tool, a convex machining side reduces the contact area between the tool (1) and the part; nevertheless, because of the elasticity of the tool (1) of the present invention, the force exerted by the operator or machine tool towards the machined part to press the tool (1) against it generates the elastic deformation of the tool, thus increasing the theoretical contact area, from a contact line to a contact area in which, because of the elasticity of the tool, the contact force is relatively uniform and the vibrations transmitted by the tool to the machine are relatively limited.

Figure 9:
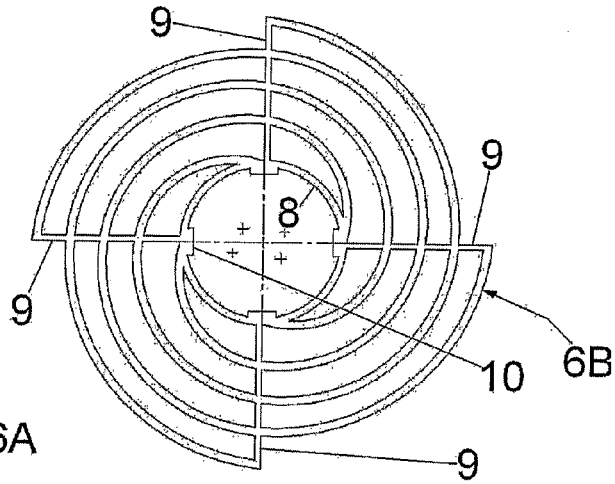
FIG. 9 illustrates an alternative advantageous executive embodiment of a grid of the bearing structure for an abrasive tool, in particular a pad, according to the present invention.

Advantageously, the presence of a metal grid (6) coupled with a polymeric body (7) not only gives elastic flexibility to the entire bearing structure of the tool (1), but also provides it with higher rigidity only in the areas where it is necessary, that is to say the areas with abrasive material: the areas with abrasive material are the parts of the metal grid (6) that protrude or emerge on the machining side (4), which are relatively more rigid than the polymeric body (7) without abrasive material. FIGS. 8 and 9 illustrate two especially advantageous constructive embodiments of a metal grid (6).

Although the grid (6) may be given any shape, as long as it is sufficiently thin and elastic, it has been proved that a spiral shape is the most advantageous shape: in fact, the spiral shape permits to mould the metal grid on an ordinary thin flat metal plate, and deform the grid (6) after moulding to give it the concave shape of the body (7) in which it is drown.

Generally, the spiral starts from a perforated central coupling element (8) designed to be coupled with the flange (5) by interference and broadens towards the shell (3).

The spiral pitch can be either constant or variable according to the distance from the centre, but is preferably constant because it is simpler to obtain.

The grid (6) can be shaped as a simple spiral, as shown in FIGS. 4 and 5, or as a spiral with transversal support arms (9) that depart from the perforated central coupling element (8), as in the grid (6A) of FIG. 8, or as in the grid (6B) of FIG. 9, in which the grid (6B) is composed of four identical spires staggered by 90° and coupled in the transversal support arms (9).

Another advantage offered by the spiral shape results from the wavelike motion of the spiral during the rotation of the tool (1), which allows to cross with the abrasive also while keeping the tool still on the piece to be machined.

Figure 10:
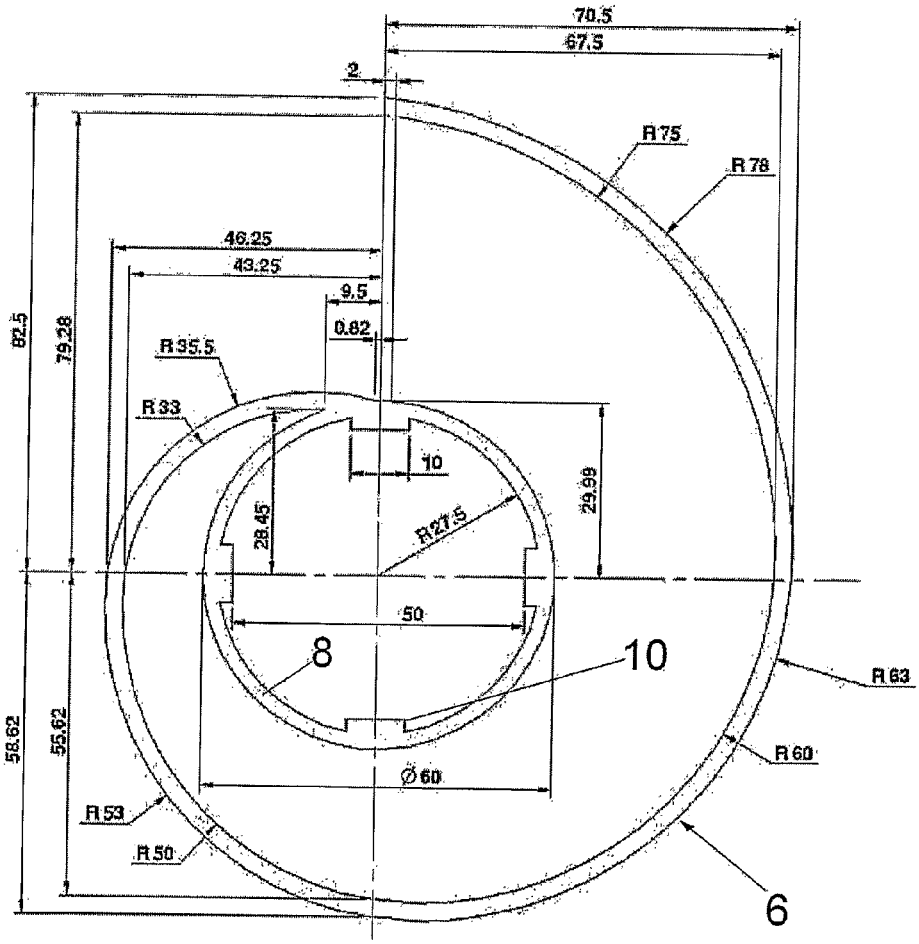
FIG. 10 illustrates an executive drawing (in mm) of a specially advantageous executive embodiment of a part of a grid of the bearing structure for an abrasive tool, in particular a pad, according to the present invention.

FIG. 10 shows a specially advantageous example with dimensions expressed in millimetres of the initial part of the spiral, that is to say the part from which the spiral departs from the perforated central coupling element (8).

The thickness of the grid (6) ranges from 1 to 10 mm; the grid is preferably made of steel, or harmonic steel, although it can be obtained with any electrically conductive material.

The polymers of the body (7) are preferably polyurethanic polymers.

The flange (5) is preferably made of aluminium.

Advantageously, the flange (5) transmits the motion to the grid (6) that transmits the motion to the body (7): in such a way, the turning moment of the motor of the machine tool is not transmitted to the central area of the polymeric body (7), which could be damaged by it, but to the grid (6), which is stronger than the body (7) and distributes it uniformly to the entire body (7), which is driven into rotation and operated without damages.

As mentioned earlier, the grid (6) is co-moulded into the body (7), i.e. first the grid (6) is obtained by moulding, shearing or laser cutting starting from a sheet metal and then the grid (6) is positioned in a mould for plastic materials, in which the concave polymeric body (7) is moulded according to the known technique, allowing part of the grid (6) to protrude or emerge from the body (7).

Now or, alternatively, before moulding the body (7) the flange (5) is coupled with the grid (6), for example by means of interference: the flange (5) is coupled with the grid (6) on the perforated central coupling element (8) by means of one or more interference ridges (10) that cooperate with corresponding housings (11) provided on the flange (5).

Now, the bearing structure is provided with an abrasive element that is necessary for functioning: the bearing structure is immersed in a galvanic bath in which a powder or granule abrasive element is dispersed.

During the galvanic bath the abrasive powders adhere to the metal surface of the grid (6) that protrudes or emerges from the body (7), on the machining side (4), while the polymeric body (7) is not coated by the abrasive material, being an electrically non-conductive material.

The invention claimed is:

1. Abrasive tool of the type suitable to be mounted on a tool machine, comprising at least a bearing structure with abrasive material, said bearing structure comprising an elastic body (7) without abrasive material, characterised in that the said bearing structure further comprises at least an elastic grid (6) associated to said elastic body (7) so that at least part of the grid (6) protrudes or emerges from the body (7), wherein said grid (6) is made of an electrically conductive material, so that the abrasive material can be fixed to the grid (6) by means of a galvanic bath.

2. Abrasive tool as claimed in claim 1, characterised in that the body (7) is made of non conductive material so that the abrasive material cannot be fixed to the grid (6) by means of a galvanic bath.

3. Abrasive tool as claimed in claim 1 characterised in that said elastic grid (6) is made of a material more rigid than the material of the elastic body (7).

4. Abrasive tool as claimed in claim 1, characterised in that said body (7) is made of plastic, silicone, or polymeric material such as polyurethanic polymers.

5. Abrasive tool as claimed in claim 1, characterised in that said grid (6) is made of metals such a steel or harmonic steel.

6. Abrasive tool as claimed claim 5, characterised in that the thickness of the grid (6) ranges from 1 to 10 mm.

7. Abrasive tool as claimed in claim 1, characterised in that the bearing structure of the tool comprises a rear side (2) without abrasive designed to be mounted facing the machine tool, and a machining side (4) designed to be mounted towards the machined piece and in which the grid (6) is partially built into the body (7) and partially protrudes or emerges towards the machining side (4); wherein the machining side (4) is convex, with concavity on the rear side (2).

8. Abrasive tool as claimed in claim 1 characterised in that the bearing structure also comprises a flange (5) for coupling the bearing structure with a machine tool, such as a grinding machine, etc.

9. Abrasive tool as claimed in claim 8, characterised in that the grid (6) has a spiral shape that starts from a perforated central coupling element (8) designed to be coupled with the flange (5) by interference and broadens outwardly.

10. Abrasive tool as claimed in claim 9, characterised in that the spiral is provided with transversal support arms (9) that depart from the perforated central coupling element (8).

11. Manufacturing process of an abrasive tool which provides for:

a. a construction of an elastic grid (6) made of electrically conductive material, b. association of said elastic grid (6) to an elastic body (7) so that at least part of the grid (6) protrudes or emerges from the body (7), c. immersion of the body (7) and the grid (6) in a galvanic bath in which a powder or granule abrasive element is dispersed, making the material or powder abrasive element adhere to the grid (6).

12. Process as claimed in claim 11, characterised in that said flexible grid (6) is obtained by means of moulding or shearing or laser cutting starting from a sheet metal.

13. Process as claimed in claim 11, characterised in that it comprises the steps of:

positioning the grid (6) in a mould for plastic materials, and co-moulding of a polymeric on the grid (6) so that to form said flexible body (7), allowing at least part of the grid (6) to protrude or emerge from the body (7).

14. Process as claimed in claim 11, characterised in that it provides for coupling the grid (6) to a flange (5) by means of interference.

* * * * *

UNITED STATES PATENT AND TRADEMARK OFFICE

CERTIFICATE OF CORRECTION

PATENT NO. : 8,393,941 B2
APPLICATION NO. : 12/735054
DATED : March 12, 2013
INVENTOR(S) : Serafino Ghinelli It is certified that error appears in the above-identified patent and that said Letters Patent is hereby corrected as shown below:

Title Page, Item 73

Currently reads: (73) Assignee: Serafino Ghonelli, Rimini (IT)

Should read: (73) Assignee: Serafino Ghinelli, Rimini (IT)

Signed and Sealed this
Fourteenth Day of May, 2013

Teresa Stanek Rea
*Acting Director of the United States Patent and Trademark Office*